US007338311B2

(12) United States Patent
Laschinksi et al.

(10) Patent No.: US 7,338,311 B2
(45) Date of Patent: Mar. 4, 2008

(54) PROTECTIVE DEVICE FOR A LOAD CURRENT CARRYING APPARATUS

(75) Inventors: Joachim Laschinksi, Kassel (DE); Stefan Buchhold, Lohfelden (DE)

(73) Assignee: SMA Technologie AG, Niestetal (DE)

( * ) Notice: Subject to any disclaimer, the term of this patent is extended or adjusted under 35 U.S.C. 154(b) by 270 days.

(21) Appl. No.: 11/263,129

(22) Filed: Oct. 31, 2005

(65) Prior Publication Data

US 2006/0077599 A1 Apr. 13, 2006

(30) Foreign Application Priority Data

Nov. 13, 2004 (DE) ..... 10 2004 054 933

(51) Int. Cl.
*H01R 4/24* (2006.01)

(52) U.S. Cl. ..... 439/441

(58) Field of Classification Search ..... 439/441, 439/136, 147, 133; 361/643; 174/66–667
See application file for complete search history.

(56) References Cited

U.S. PATENT DOCUMENTS

| | | | | |
|---|---|---|---|---|
| 2,439,708 | A * | 4/1948 | Abraham | 200/50.1 |
| 4,063,110 | A * | 12/1977 | Glick | 307/112 |
| 4,603,931 | A * | 8/1986 | Ruffman | 439/133 |
| 5,542,425 | A | 8/1996 | Marshall et al. | |
| 6,375,619 | B1 | 4/2002 | Ohdachi | |

FOREIGN PATENT DOCUMENTS

| | | |
|---|---|---|
| DE | G 94 09 534.5 | 8/1994 |
| DE | 101 51 163 | 4/2003 |
| DE | 102 25 259 B3 | 1/2004 |
| DE | 198 82 471 T5 | 4/2004 |
| EP | 0 437 696 | 7/1991 |

OTHER PUBLICATIONS

EP Search Report 05 02 3391, Feb. 17, 2006.

* cited by examiner

*Primary Examiner*—J. F. Duverne
(74) *Attorney, Agent, or Firm*—Thomas R. Vigil

(57) ABSTRACT

The object of the invention is a protective device for a load carrying apparatus for preventing or reducing an electric arc during separation of the load current carrying plug connectors (2) using a switch (7) that reduces the load current to such an extent that the load current that remains is harmless, with a protective cover (5) for the load current plug connectors (2), said cover being securable to the apparatus and making it more difficult to remove the load current plug connectors (2) as long as it is secured to the apparatus, said protective cover (5) comprising a means that is operably connected to the switch in such a manner that the load current is reduced by the switch (7) when the protective cover is removed from the apparatus, said protective cover (5) comprising electrical contacts (10) for an electrical means and for electrical connection to additional contacts on the apparatus so that the contacts (10) of the protective cover (5) are separated from the additional contacts (11) and the load current is reduced when the protective cover is being removed.

12 Claims, 5 Drawing Sheets

PROTECTIVE DEVICE FOR A LOAD CURRENT CARRYING APPARATUS

BACKGROUND OF THE INVENTION

1. Field of the Invention

The invention relates to a protective system for a load current carrying apparatus for preventing or reducing an electric arc during separation of the load current carrying plug connectors using a switch that reduces the load current to such an extent that the load current that remains is harmless, with a protective cover for the load current plug connectors, said cover being securable to the apparatus and making it more difficult to remove the load current plug connectors as long as it is secured to the apparatus, said protective cover comprising a means that is operably connected to the switch in such a manner that the load current is reduced by the switch when the protective cover is removed from the apparatus.

2. Description of the Prior Art

The document DE 102 25 259 B3 describes a protective device in which arc flash protection is realized by utilizing a clocked semiconductor component. Said component is connected in series to an auxiliary contact. Said auxiliary contact is configured to be a trailing contact so that it is separated after the load current contact. As a result, the load current is reduced to such an extent that no electric arc occurs when the load current contacts are separated.

Inverters with an integrated direct current air break switch disconnector are known. There is however a risk that one forgets to actuate it prior to unplugging the load connector plugs. An electric arc may thus occur, which may endanger people.

A system for the grid connection of a solar generator that is provided with a module distributor and a grid coupling apparatus is known from the document DE 94 09 534 U1. The module distributor thereby comprises inputs for solar modules and one output to a grid coupling apparatus, said grid coupling apparatus being wired to one or a plurality of inverters and comprising moreover an output for one phase of the alternating current grid. The inverter has a cover that mechanically deenergizes the inverter when lifted.

With regard to an ultrasonic diagnostic apparatus, it is known from U.S. Pat. No. 6,375,619 B1 that an electrical contact is provided on the locking mechanism associated with a plug-and-socket connector.

A protective device of the type mentioned herein above is known both from DE 198 82 471 T5 and from U.S. Pat. No. 5,542,425 A. A detector switch thereby detects the opening of the protective cover, an internal change-over circuit of the power control unit being opened when the detector switch is gated during battery loading or while current is supplied by the battery.

BRIEF SUMMARY OF THE INVENTION

It is the object of the invention to provide a generic protective device that readily provides electric arc protection.

The solution to this object is provided by the characterizing features of claim 1 in conjunction with the features recited in the preamble thereof, with the switch being configured to be a semiconductor switch, a clocked semiconductor switch, a relay or a so-called single use switch. The term "single use switch" is understood to refer to a switch which, after having been actuated once, can no longer be closed; it functions as a kind of fuse.

On the one side, the protective cover of the invention prevents the load current contacts from being physically disengaged as long as they are mounted to the apparatus. On the other side, the protective cover can be removed. Upon removal of the protective cover, the means of the invention, which makes use of the clocked semiconductor component, comes into action. It reduces the load current to such an extent that no electric arc or only a harmless electric arc is allowed to occur upon physically disengaging the load current contacts.

The protective cover of the invention allows additional air break switch disconnectors to be eliminated altogether in the apparatus since separation under high load current conditions is not possible without the invention. In this manner, the corresponding standards and regulations are met.

The control means can be a mechanical or an electromechanical means. An actuation pin or the like may for example be provided on the protective cover, said pin actuating a switch provided on the apparatus when the protective cover is mounted. The switching contacts of the switch are parallel to the clocked semiconductor switch. Said semiconductor switch in turn lies within the load current circuit, more specifically in the direct current circuit. If the protective cover is mounted, the switch is for example closed so that the load current flows through the switch. If the protective cover is removed, the contact is open so that the load current flows through the clocked semiconductor switch. As this current is now reduced or clocked, electric arc protection is provided.

Preferably however, an electric solution is utilized in which the protective cover comprises electrical contacts for electrical connection to additional contacts on the apparatus so that, when the protective cover is being removed, the contacts of the protective cover are separated from the additional contacts and the load current is reduced. This solution more specifically provides for a protective cover including a jumper as a means for shorting the additional contacts through the contacts of the protective cover when the protective cover is mounted.

The jumper integrated in the protective cover provides for a very simple control of the load current. When the cover is mounted, the jumper is engaged and the load current may be high. If the jumper or rather the cover is removed, the current generated is reduced by the clocked semiconductor component which continuously interrupts the current at regular or also irregular intervals.

In accordance with an advantageous embodiment of the invention, there is provided that the jumper is connected in parallel to the semiconductor component and that the semiconductor component with the jumper lies in the load current circuit. In this configuration, a closed switch would bridge the semiconductor component. Electricity tends to the path of least resistance. When the protective cover is mounted, the load current flows through the low resistance bridge. If said bridge is missing because the cover has been removed, the current is forced to flow through the clocked semiconductor switch. As a result, the load current is reduced to a harmless level.

The semiconductor component can be clocked continuously to advantage, which can be readily implemented. Since load current flows through the low resistance current bridge when the protective cover is mounted, no switching losses are generated at the semiconductor component, which results in high efficiency.

The solution of the invention permits to readily extend existing inverter circuits if the apparatus includes an inverter module and if the semiconductor component is accommodated in a clock module that is electrically connected to the inverter module.

Further improved implementations of the invention are recited in the subordinate claims.

The invention and its advantages will now be discussed in further detail with reference to the drawing. In said drawing:

DETAILED DESCRIPTION OF THE INVENTION

Figure 1:
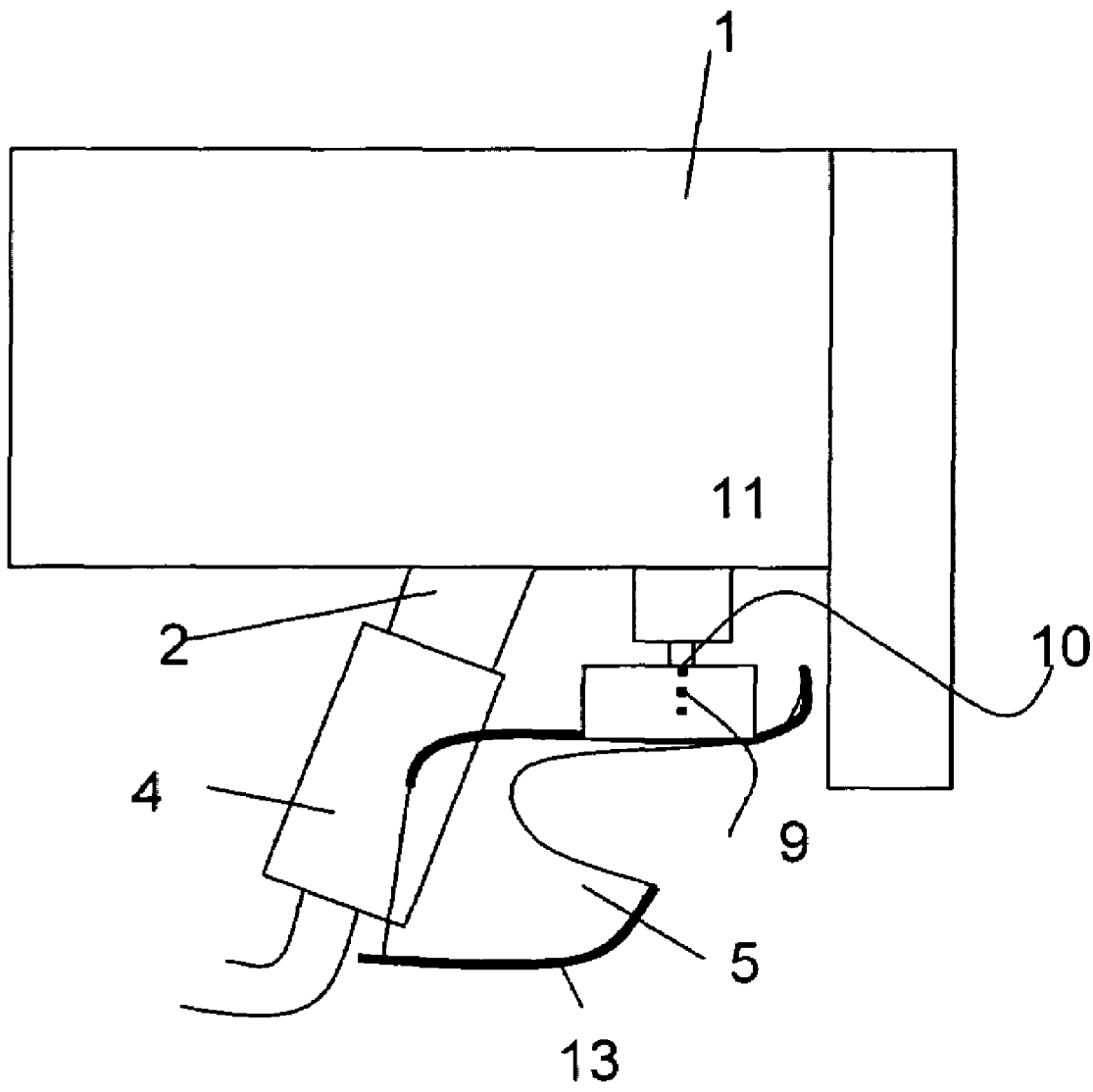
FIG. 1 shows a schematic representation of an inverter having a protective device of the invention.

FIG. 1 shows a preferred embodiment of the protective device of the invention for a photovoltaic inverter 1.

The inverter 1 is provided with plug connectors 2 carrying a load current for a direct current voltage circuit provided on the input side. PV plugs 4 (photovoltaic plugs), which are connected to photovoltaic modules 3 (solar generators), can be connected to the plug connectors 2, as can be seen from FIG. 2. The protective device is preferably located on a direct current circuit, more specifically to a current circuit provided on the input side (DC circuit).

Figure 3:
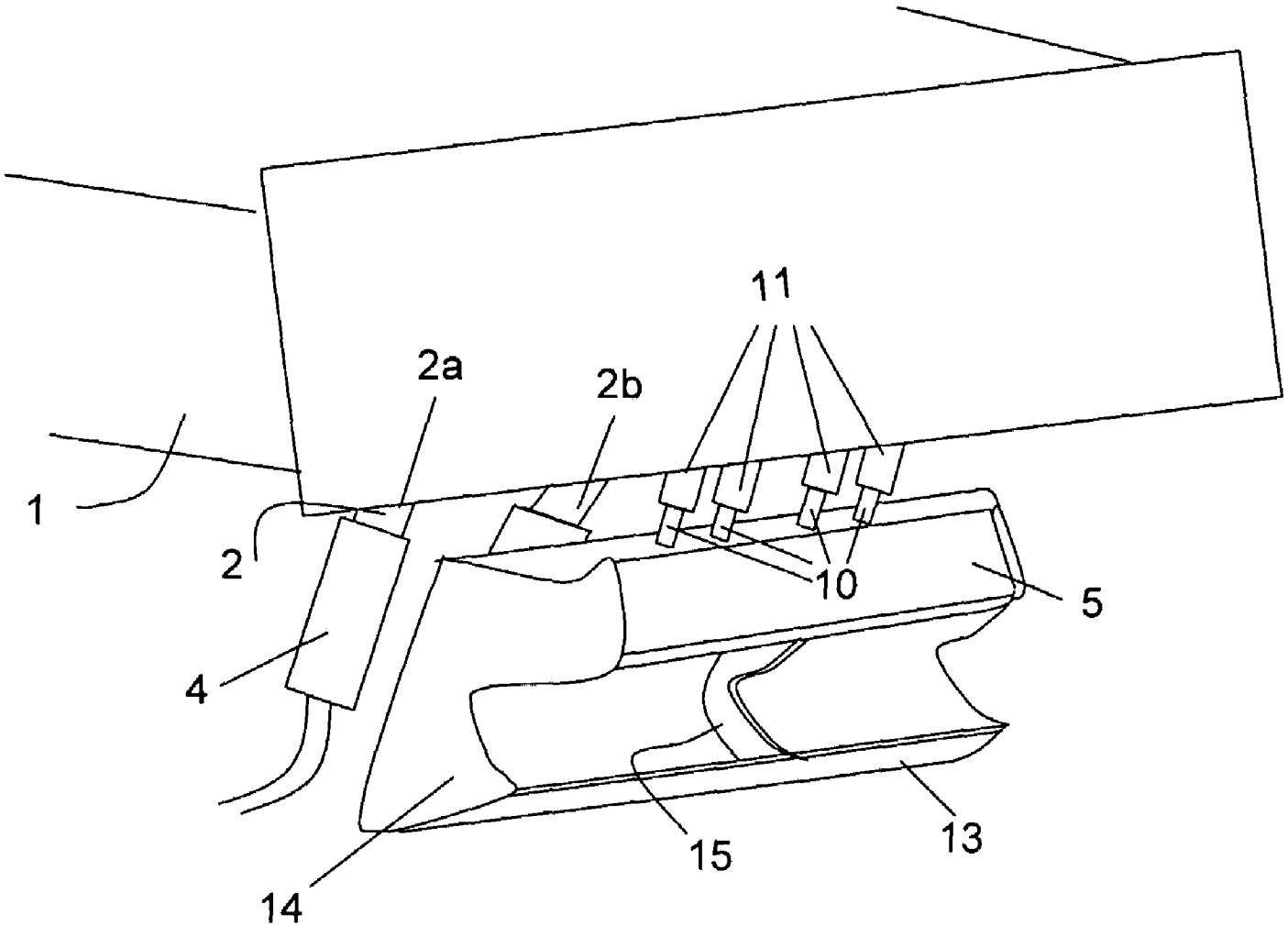
FIG. 3 shows a perspective representation of the protective device.

A protective cover 5 is adapted to be mounted in front of the PV plugs or the plug connectors 2, as illustrated in the FIGS. 1 and 3. The protective cover 5 can be secured so as to form an interlocking and/or self-adhering relationship with a housing of the inverter 1. In the mounted condition, the cover prevents the PV plugs 4 from becoming physically disengaged and the load current circuit from being interrupted during high current conditions. For interrupting the load current circuit during high load current conditions would cause an electric arc to occur.

Figure 2:
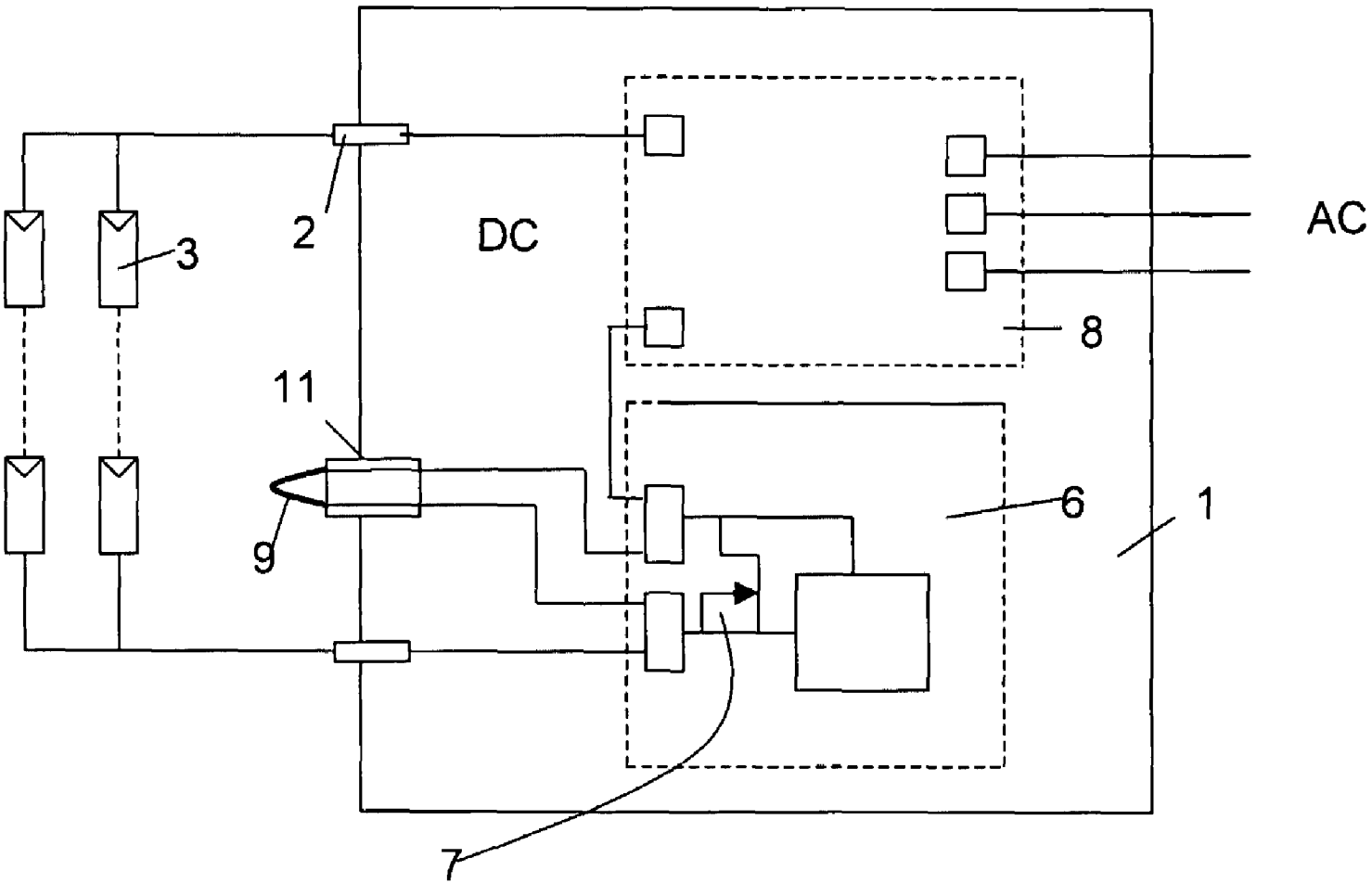
FIG. 2 shows a block diagram of a circuit of the protective device.

In order to reduce this high load current, a module 6 having a clocked semiconductor switch 7 is connected in series to an inverter circuit or to an inverter module 8, as shown in FIG. 2. In order to bridge the semiconductor switch 7 during operation or when the protective cover 5 is mounted, it is preferred to utilize a current bridge or a jumper 9 that is integrated in the protective cover 5. Through contacts 10 and additional contacts 11 provided on the protective cover 5 the jumper 9 is automatically connected to the housing of the inverter 1 when the protective cover 5 is mounted. In operation, the load current can thus flow through the jumper 9 with little loss. The jumper 9 is connected virtually parallel to the semiconductor switch 7.

When the protective cover 5 is removed, the clocked semiconductor switch 7 or the clocked module 6 are mounted in series with the inverter circuit or the inverter module 8. When the protective cover 5 is being removed in order to unplug the PV plugs 4, the current is forced to flow through the clocked semiconductor switch 7 so that the load current that remains is harmless with no, or at the most a harmless, electric arc remaining when the PV plugs 4 are physically disengaged.

In accordance with the invention there is provided a protective cover 5 for the load current plug connectors 4, said cover being adapted to be secured to the apparatus and preventing the load current plug connectors 4 from being physically disengaged as long as it is secured to the apparatus and said protective cover 5 comprising an electrical and/or mechanical means (jumper) that is operably connected to the semiconductor component or to the semiconductor switch 7 in such a manner that the load current is reduced by the semiconductor switch 7 when the protective cover 5 is removed from the apparatus.

The means or rather control means integrated in the protective cover 5 controls the load current in a simple manner in the largest sense of the word.

Figure 4:
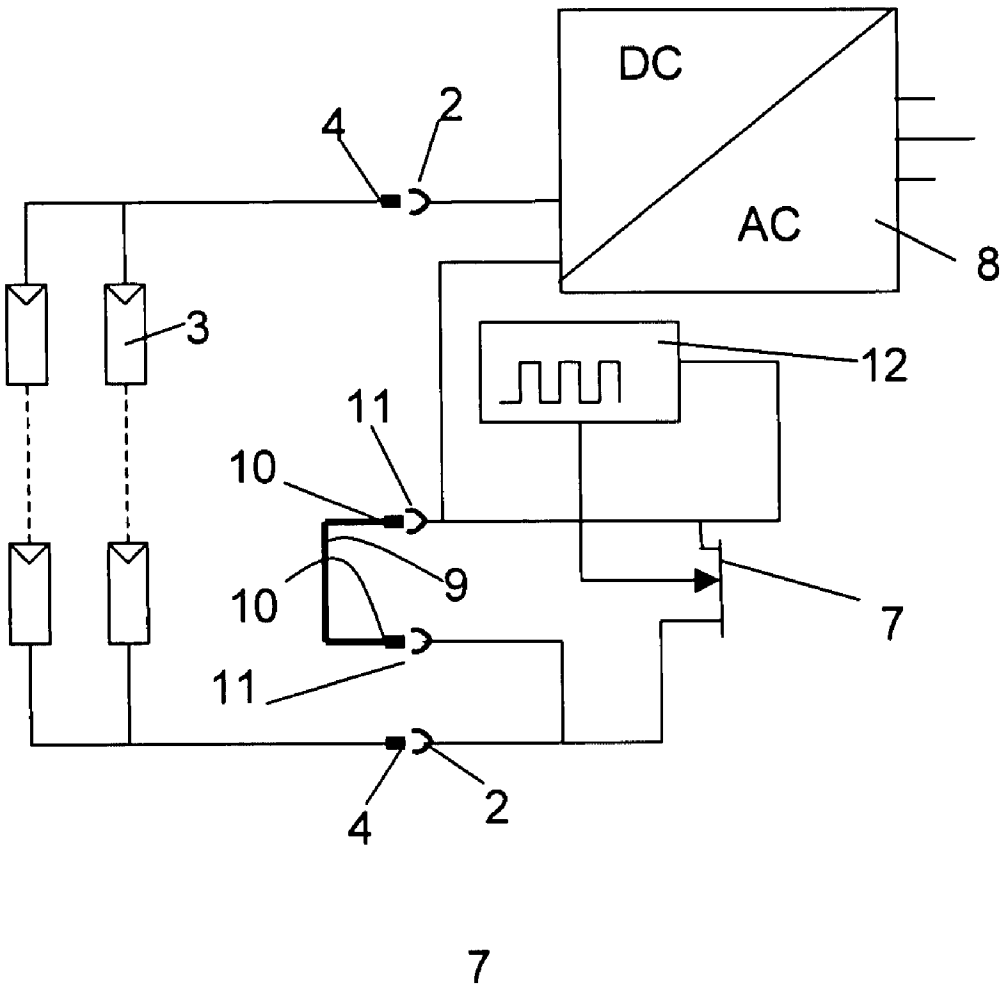
FIG. 4 shows a wiring diagram of the circuit arrangement of the protective device.

FIG. 4 shows another wiring diagram showing the arrangement of the jumper 9 and of the semiconductor switch 7. From this Figure it can be readily seen that the jumper 9 preferably shorts out additional contacts 11 and that it is parallel to the semiconductor switch 7. The additional contacts 11 are secured to the apparatus. The semiconductor switch 7 is triggered by a clocked control unit 12 so that the semiconductor component is continuously clocked. Clock timing is thereby set so that no harmful electric arc occurs at the additional contacts 11 when the protective cover 5 is being removed.

Figure 6:
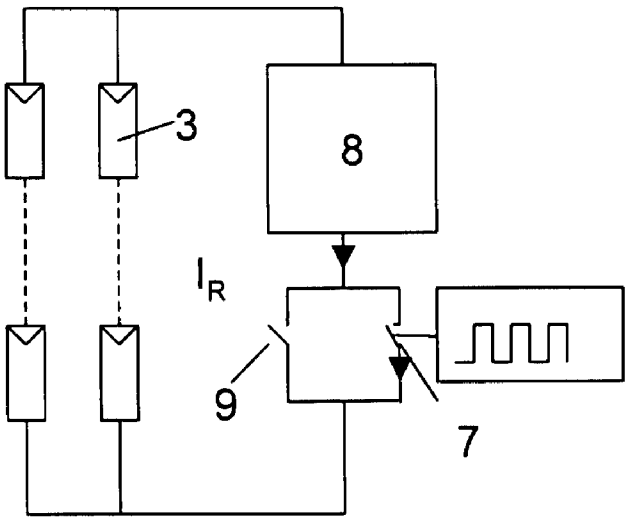
FIG. 5 shows a simplified wiring diagram with the protective cover being mounted and FIG. 6 shows a simplified wiring diagram with the protective cover being removed.
Figure 5:
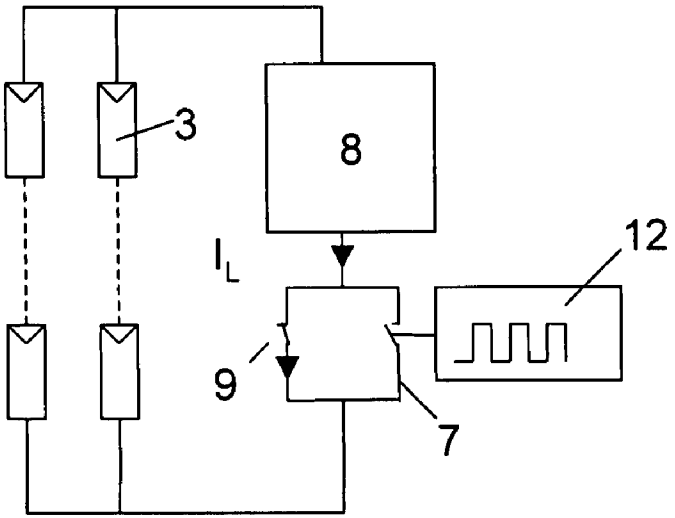

The FIGS. 5 and 6 show the principle of the current reduction of the invention. For simplicity's sake, the semiconductor switch 7 is shown as a switch. The jumper 9, which is also shown as a switch for simplicity's sake, is located parallel thereto.

When the protective cover 5 is mounted, the switch 9 is closed. The load current $I_L$ flows through the switch 9, as shown in FIG. 5. When the protective cover 5 is removed, a reduced flow $I_R$ flows through the switch 7, as shown in FIG. 6.

Therefore, a mechanical or an electromechanical solution may also be envisaged instead of the electrical solution making use of a jumper. The switch 9 could be integrated in the apparatus and be configured to be mechanically actuatable through the protective cover 5. An actuation pin or the like, which would be secured to the protective cover 5, could serve for actuation.

As can be further seen from the FIGS. 1 and 3, the protective cover 5 comprises a grip 13 that is preferably formed like a wall. As can be seen from FIG. 3, the protective cover 5 conceals both the additional contacts 11 and the load current or PV contacts. The protective cover 5 is preferably made from plastic material such as a thermosetting or a thermoplastic material. It has for example a three-dimensional shape and is preferably provided with end walls 14, as can be seen from FIG. 3. A central ridge 15 stiffens the cover or the wall serving as a grip 13.

It is preferred to use one contact 2*a*, 2*b* for each independent input of the inverter. Four or more contacts 2 are preferably provided. Therefore, a plurality of additional contact pairs are used, more specifically two pairs, as shown in FIG. 3.

Thus, the protective cover 5 is disposed in accordance with the invention on the inverter in such a manner that in their mounted or plugged condition the plugin connections of the inverter are concealed and cannot be actuated. By removing the protective cover 5 through the integrated electrical contacts, a function is enabled that ensures that the current flowing through the plugin connections is at least harmless for physically disengaging the connecting plug of the inverter. By removing the protective cover 5, access to the plugin connections (contacts 2) is further allowed so that, at the latest when the plugin connections are physically disengaged from the inverter next, separation from the current source (e.g., PV installation) mounted upstream thereof is completed.

The additional operating unit for covering the plug-and-socket connectors of the inverter efficiently prevents an electric arc that could endanger people from occurring. As contrasted with an electromechanical air break switch disconnector integrated in inverters, the load current is not completely switched off; a clocked low current remains instead. By permanently switching the semiconductor switch on and off, one not only reduces the current but also quenches an electric arc as a result of clock timing.

It is further possible to install in the inverter, instead of the contacts installed in the protective cover 5, a switch or a push button in such a manner that it is actuated by plugging the additional member into the inverter.

As an alternative to the removable protective cover there may be utilized a pivotal, hinged cover.

We claim:

1. A protective device for a load carrying apparatus for preventing or reducing an electric arc during separation of the load current carrying plug connectors (2) using a switch (7) that reduces the load current to such an extent that the load current that remains is harmless, with a protective cover (5) for the load current plug connectors (2), said cover being securable to the apparatus and making it more difficult to remove the load current plug connectors (2) as long as it is secured to the apparatus, said protective cover (5) comprising a means that is operably connected to the switch in such a manner that the load current is reduced by the switch (7) when the protective cover is removed from the apparatus, characterized in that the protective cover (5) comprises electrical contacts (10) for an electrical means and for electrical connection to additional contacts on the apparatus so that the contacts (10) of the protective cover (5) are separated from the additional contacts (11) and the load current is reduced when the protective cover is being removed.

2. The protective device as set forth in claim 1, characterized in that the protective cover (5) includes a jumper (9) as a means for shorting the additional contacts (11) when the protective cover (5) is mounted.

3. The protective device as set forth in claim 2, characterized in that the jumper (9) is connected in parallel to the switch (7) and that the switch (7) with the jumper (9) lies in the load current circuit.

4. The protective device as set forth in claim 1, characterized in that the switch (7) is a semiconductor switch.

5. The protective device as set forth in claim 4, characterized in that the switch (7) is a clocked semiconductor switch.

6. The protective device as set forth in claim 4, characterized in that the switch (7) is a relay.

7. The protective device as set forth in claim 4, characterized in that the switch (7) is configured to be a switch that may only be actuated once.

8. The protective device as set forth in claim 5, characterized in that the semiconductor switch (7) is clocked continuously.

9. The protective device as set forth in claim 1, characterized in that the apparatus includes an inverter module (8) and that the switch (7) is accommodated in a clock module (6) that is electrically connected to the inverter module (8).

10. The protective device as set forth in claim 1, characterized in that the apparatus is configured to be a photovoltaic inverter.

11. The protective device as set forth in claim 1, characterized in that the protective cover (5) comprises a grip (13).

12. The protective device as set forth in claim 11, characterized in that the grip (13) in the shape of a wall is formed integral with the protective cover (5).

* * * * *